US005101635A

United States Patent [19]

Mita et al.

[11] Patent Number: 5,101,635

[45] Date of Patent: Apr. 7, 1992

[54] REFRIGERATION SYSTEM

[75] Inventors: Hideo Mita, Okazaki; Hideo Misawa, Anjo; Akiyoshi Hirano, Toyota; Yoshihira Shiroshita, Toyoake, all of Japan

[73] Assignee: Aisin Seiki Kabushiki Kaisha, Kariya, Japan

[21] Appl. No.: 675,815

[22] Filed: Mar. 27, 1991

[30] Foreign Application Priority Data

Mar. 30, 1990 [JP] Japan ..... 2-85266

[51] Int. Cl.[5] ..... F25B 9/00

[52] U.S. Cl. ..... 62/6; 60/520

[58] Field of Search ..... 62/6; 60/520

[56] References Cited

U.S. PATENT DOCUMENTS 4,335,579 6/1982 Sugimoto ..... 62/6
4,498,296 2/1985 Dijkstra et al. ..... 62/6
4,700,545 10/1987 Ishibashi et al. ..... 62/6
4,845,953 7/1989 Misawa et al. ..... 62/6

FOREIGN PATENT DOCUMENTS 4317026 7/1943 Japan .

*Primary Examiner*—Ronald C. Capossela
*Attorney, Agent, or Firm*—Oblon, Spivak, McClelland, Maier & Neustadt

[57] ABSTRACT

A refrigeration system includes a refrigerator having a compression portion having a compression cylinder and a compression piston moving slidably in the cylinder, a first heat excahnger, a regenerator and a second heat exchanger. An expansion portion has an expansion cylinder and an expansion piston moving slidably in the cylinder. A drive device drives the compression piston via a first rod and the expansion piston via a second rod. The compression cylinder includes a first large diameter portion where the compression piston is slidably moved and a first small diameter portion where the first rod is slidably moved, and the expansion cylinder includes a second large diameter portion where the expansion piston is slidably moved and a second small diameter portion where the second rod is slidably moved.

2 Claims, 3 Drawing Sheets

REFRIGERATION SYSTEM

BACKGROUND OF THE INVENTION

1. Field of the Invention

The present invention relates to a refrigeration system and more particularly to a refrigeration system able to achieve a temperature under 6 degrees Kelvin by the combination of a main-refrigerator and a sub-refrigerator.

2. Description of the Related Art

A conventional refrigeration system 500, as shown in FIG. 3, is disclosed in Japanese Utility Model Publication No. 43(1968)17026. In the refrigeration system 500, a first compression portion 501 which is formed by a piston 502 and a cylinder 503 is in fluid communication with a first expansion portion 504 which is formed by a piston 505 and a cylinder 506 via a heat exchanger 507, a regenerator 508 and a conduit 509. The conduit 509 is formed in a first cold-head 510.

Further, a second compression portion 511 which is formed by a piston 512 and a cylinder 513 is in fluid communication with a second expansion portion 514 which is formed by a piston 515 and a cylinder 516 via a heat radiation apparatus 517, a regenerator 518 and a conduit 519. The conduit 519 is formed in a second cold-head 520. The heat radiation apparatus 507 is thermally connected with the second cold-head 520. The pistons 502, 505, 512, 515 are driven by a driving means 521.

In the conventional refrigeration system 500, the diameter of each of the pistons 502, 505, 515 is constant from one end thereof to the other end thereof. Thus, atmospheric heat can invade the first compression portion 501, the first expansion portion 504 and the second expansion portion 514 via the pistons 502, 505, 515 due to heat conduction as the pistons reciprocate. So, the refrigerating capacity of the refrigeration system 500 is reduced.

SUMMARY OF THE INVENTION

Accordingly, it is a primary object of the present invention to prevent atmospheric heat from invading a compression and expansion portion of a refrigeration system.

The above and other objects are achieved according to the present invention by a refrigeration system which comprises a refrigerator including a compression portion having a compression cylinder, and a compression piston moving slidably in the cylinder, a first heat exchanger, a regenerator and a second heat exchanger. An expansion portion has an expansion cylinder and an expansion piston moving slidably in the cylinder. Driving means drive the compression piston via a first rod and the expansion piston via a second rod. The compression cylinder comprises a first large diameter portion where the compression piston is slidably moved and a first small diameter portion where the first rod is slidably moved. The expansion cylinder comprises a second large diameter portion where the expansion piston is slidably moved and a second small diameter portion where the second rod is slidably moved.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing, wherein.

DETAILED DESCRIPTION OF THE PREFERRED EMBODIMENTS

Figure 1:
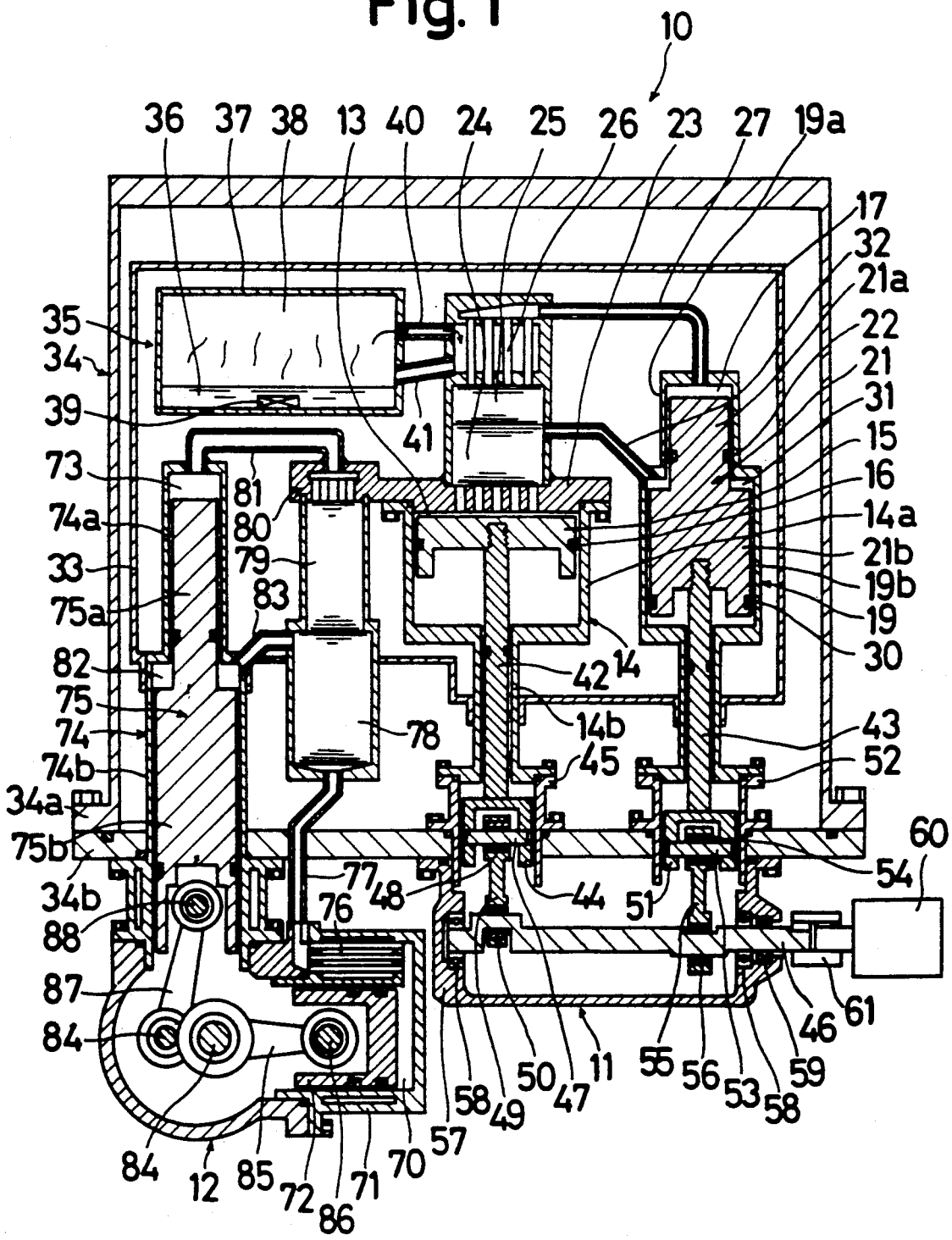
FIG. 1 is a cross-sectional view of a refrigeration system according to one embodiment of the invention.

Referring first to FIG. 1 wherein a refrigeration system 10 is shown. The refrigeration system 10 is the combination of a main-refrigerator 11 and a sub-refrigerator 12, each of which uses a Stirling cycle. In the main-refrigerator 11, a compression portion 13 which is formed by a cylinder (compression cylinder) 14, a piston (compression piston) 15 and a seal ring 16 is in fluid communication with a first expansion portion 17 which is formed by a small diameter portion 19*a* of a cylinder (expansion cylinder) 19, a small diameter portion 21*a* of a piston (expansion piston) 21 and a seal ring 22. Between the compression portion 13 and the first expansion portion 17 are located a first heat exchanger 23, a first regenerator 24, a second regenerator 25, a condenser (second heat exchanger) 26 and a conduit 27.

A second expansion portion 31 is also in fluid communication with the compression portion 13 via the first heat exchanger 23, the first regenerator 24 and a conduit 32. The second expansion portion 31 is formed by a large diameter portion 19*b* of a cylinder 19, a large diameter portion 21*b* of a piston 21 and a seal ring 30.

In the main-refrigerator 11, the above-mentioned members are located in a thermal shield casing 33 which is located in a vacuum casing 34. The vacuum casing 34 comprises a body 34*a* and a cover 34*b*, and is kept in a vacuum condition.

In a cooled means 35, an amount of liquid helium 36 is stored in a vessel 37, and a vapor phase 38 is defined above the liquid helium 36. A substance 39 to be cooled is immersed in the liquid helium 36. The vessel 37 is in fluid communication with the condenser 26 via a first conduit 40 and a second conduit 41. The cooled means 35 is also located in the thermal shield casing 33.

The cylinder 14 comprises a large diameter portion 14*a* and a small diameter portion 14*b*. An inner diameter of the large diameter portion 14*a* is about the same as an outer diameter of the piston 15. An inner diameter of the small diameter portion 14*b* is about the same as an outer diameter of a rod (first rod) 42. The diameter of the small diameter portion 14*b* is sufficiently smaller than the diameter of the large diameter portion 14*a* for preventing the invasion of the atmospheric heat into the compression portion 13. That is, despite the fact that the rod 42 reciprocates into the large diameter portion 14*a*, since it has a small sectional area (corresponding to the small diameter of portion 14*b*) the amount of heat transferred in this way is minimal.

The cylinder 19 comprises the small diameter portion 19*a*, the large diameter portion 19*b* and a portion 19*c*. An inner diameter of the small diameter portion 19*a* is as about same as an outer diameter of the small diameter portion 21*a* of the piston 21. An inner diameter of the large diameter portion 19*b* is as about same as an outer diameter of the large diameter portion 21*b* of the piston 21. An inner diameter of the portion 19*c* is as about same as an outer diameter of a rod (second rod) 43. The diameter of the portion 19c is sufficiently smaller than the diameter of the large diameter portion 19b for preventing the invasion of atmospheric heat into the second expansion portion 13 for the reason noted above with respect to cylinder 14.

One end of the rod 42(43) is connected with the piston 15(21), and the other end thereof is connected with a guide piston 44(51) which is slidably moved in a guide cylinder 45(52). The guide piston 44(51) is connected with a crank shaft 46 via a pin 47(53), a bearing 48(54), a connecting rod 49(55) and a bearing 50(56). The crank shaft 46 is rotatably supported in a cover 57 via bearings 58 and a seal 59, and is connected with a driving means 60 by a coupling 61. The phase of the guide piston 44 is shifted by 75~90 degrees behind the phase of the guide piston 51, by the crank shaft 46. Namely, the phase of the compression portion 13 is shifted 75~90 degrees behind the phase of the first and second expansion portions 17, 31.

In the sub-refrigerator 12, a compression portion 70 which is formed by a cylinder 71 and a piston 72 is in fluid communication with a first expansion portion 73 which is formed by a small diameter portion 74a of a cylinder 74 and a small diameter portion 75a of a piston 75 via a heat radiation apparatus 76, a conduit 77, a first regenerator 78, a second regenerator 79, a heat exchanging member 80 and a conduit 81. Further, a second expansion portion 82 is also in fluid communication with the compression portion 70 via the heat radiation apparatus 76, the conduit 77, the first regenerator 78 and a conduit 83. The second expansion portion 82 is formed by a large diameter portion 74b of a cylinder 74 and a large diameter portion 75b of a piston 75. The first heat exchanger 23 is thermally connected with the heat exchanging member 80.

The first expansion portion 73, the second regenerator 79, the heat exchanging member 80 and the conduits 81, 83 are located in the thermal shield casing 33. The first regenerator 78 and the second expansion portion 82 are located in the vacuum casing 34.

In the sub-refrigerator 12, the piston 72 is driven by a crank shaft 84 which is connected to a driving means (not shown, e.g., electric motor) via a connecting rod 85 and a pin 86. The piston 75 is driven by the crank shaft 84 via a connecting rod 87 and a pin 88. The phase of the guide piston 72 is shifted by 75~90 degrees behind the phase of the guide piston 75, by crank shaft 84. Namely, the phase of the compression portion 70 is shifted 75~90 degrees behind the phase of the first and second expansion portions 73, 82.

In the above-mentioned refrigeration system 10, the function or operation of the system 10 will be described as follows:

In the sub-refrigerator 12, the working gas (e.g., helium gas) whose pressure is about 20 kg/cm$^2$ flows back and forth between the compression portion 70 and the first expansion portion 73 and between the compression portion 70 and the second expansion portion 83. Due to the driving of the sub-refrigerator 12, refrigeration at 80 degrees Kelvin is generated at the second expansion portion 82, and refrigeration at 15~30 degrees Kelvin is generated at the first expansion portion 73. So, the heat exchanging member 80 and the first heat exchanger 23 are cooled to about 15~30 degrees Kelvin.

In the main-refrigerator 11, the working gas (e.g., helium gas) whose pressure is about 1 kg/cm$^2$ flows back and forth between the compression portion 13 and the first expansion portion 17, and between the compression portion 13 and the second expansion portion 31. Namely, the working gas which is compressed in the compression portion 13 flows through the first heat exchanger 23. At this time, the working gas is cooled by the refrigeration at 15~30 degrees Kelvin generated at the sub-refrigerator 12. Next, the working gas flows through the first and second heat accumulators 24, 25, and is further cooled therein. Next, the working gas flows into the expansion portion 17 via the condenser 26. Here, due to the moving of the small diameter portion 21a of the piston 21 downwardly, the working gas expands isothermally. So, refrigeration at about 4.2 degrees Kelvin is generated therein.

Next, due to the moving of the small diameter portion 21a of the piston 21 upwardly, the working gas flows through the condenser 26. Here, the vapor helium in the vapor phase 40 of the vessel 39 flows into the condenser 26 via the first conduit 40, and is condensed in the condenser 26 by the refrigeration of 4.2 degrees Kelvin. Therefore, the vapor helium changes to liquid helium, and the liquid helium flows into the vessel 39 via the second conduit 41.

Finally, the working gas flows into the compression portion 13 via the second and first regenerators 25, 24 and the first heat exchanger 23, with increasing the temperature thereof, and one cycle of the Stirling cycle of the main refrigerator 11 ends.

Figure 2:
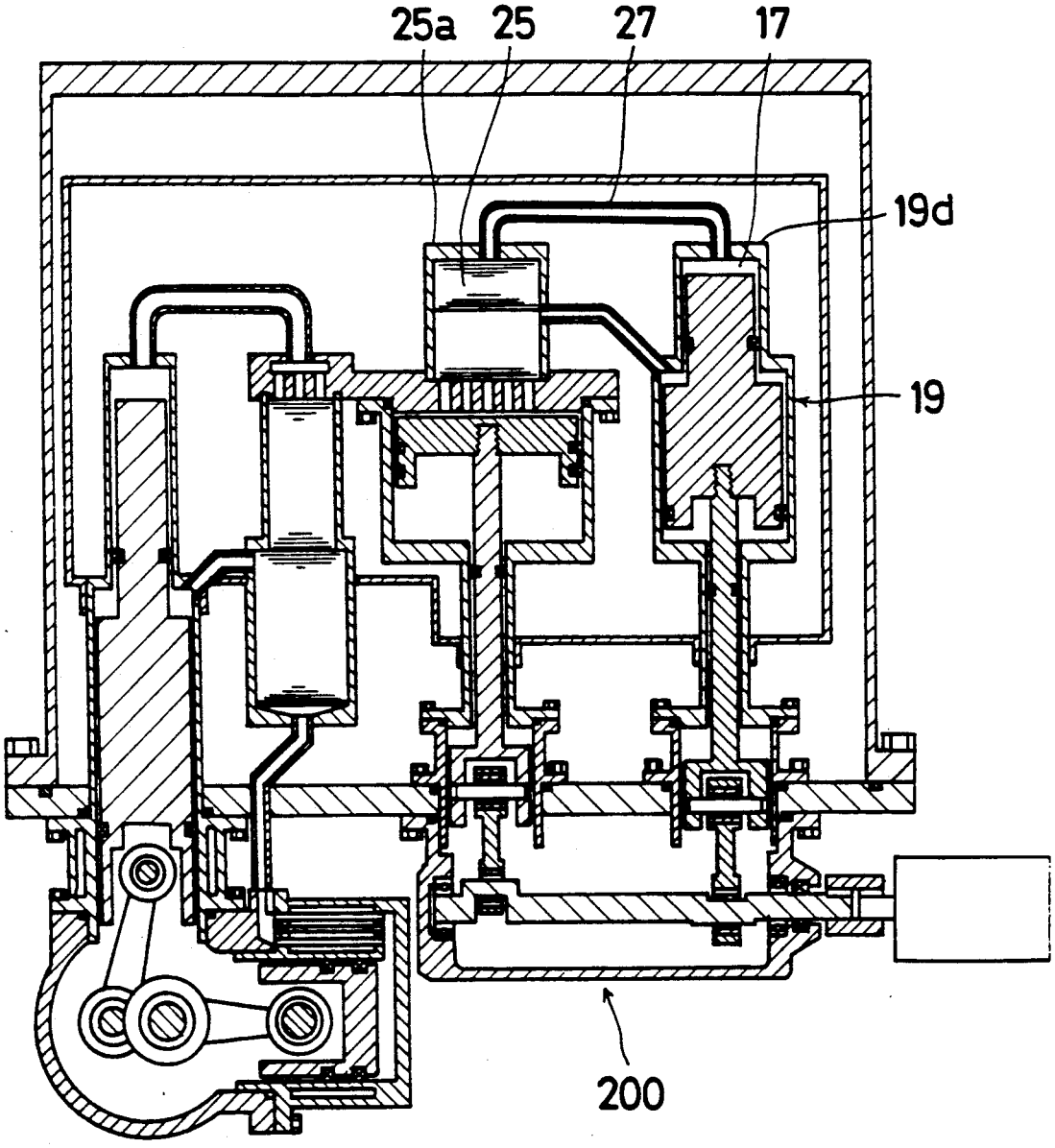
FIG. 2 is a cross-sectional view of a refrigeration system according to another embodiment of the invention.
Figure 3:
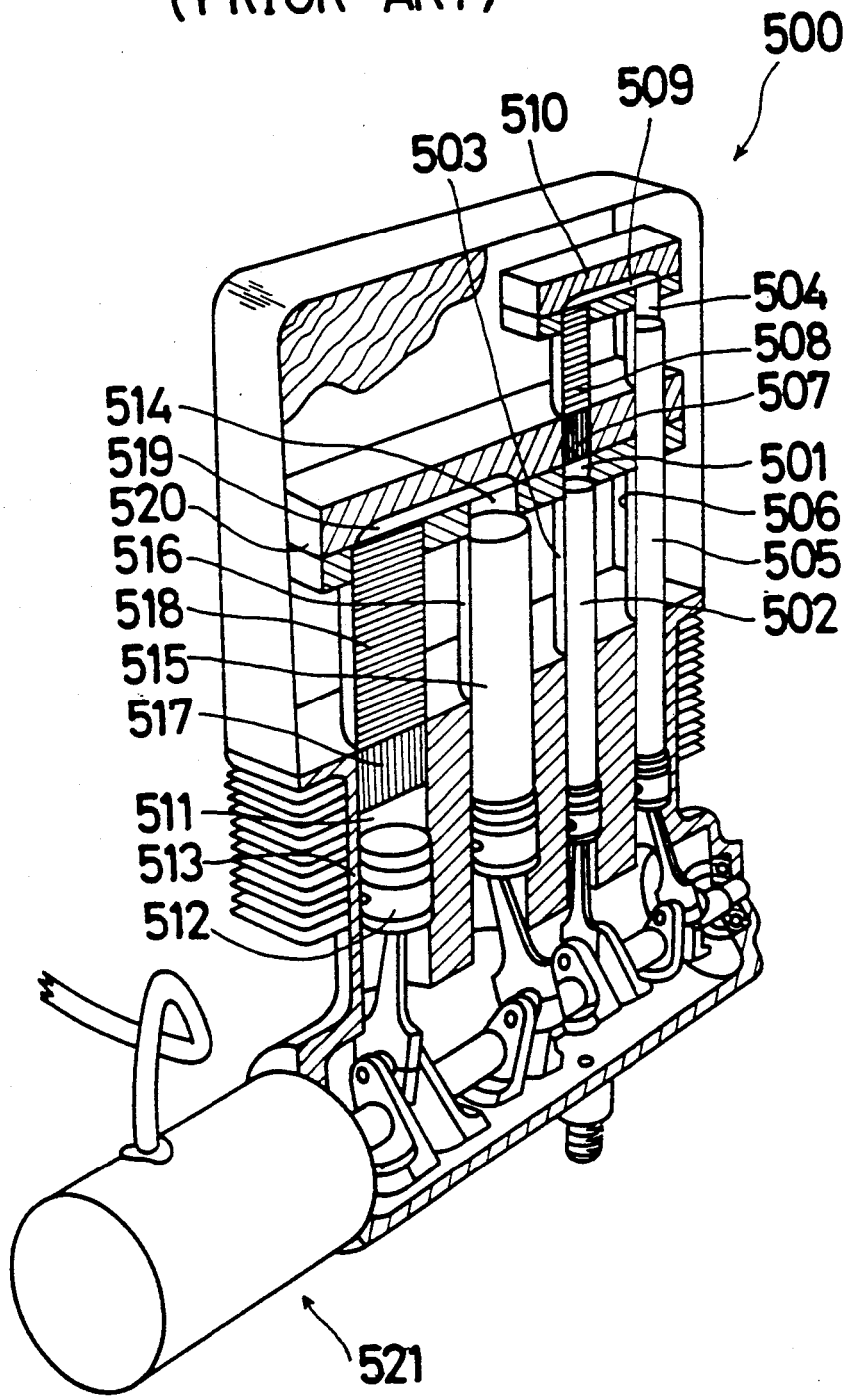
Fig. 3 (PRIOR ART)
FIG. 3 is a perspective view of a conventional refrigeration system 500.

Next, referring to FIG. 2, which shows a refrigeration system 200 of a second embodiment according to the present invention, only the construction different from the first embodiment will be described hereinafter.

In the second embodiment, the condenser 26 and the cooled means 35 are not provided. So, the refrigeration at about 4.2 degrees Kelvin is generated at a head 19d of the cylinder 19 or at a head 25a of the second heat accumulator 25.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A refrigeration system comprising:

a refrigerator including a compression portion having a compression cylinder and a compression piston moving slidably in the cylinder to define a compression portion;

a first heat exchanger in thermal communication with the compression portion;

a regenerator in thermal communication with the first heat exchanger;

a second heat exchanger in thermal communication with the regenerator; and an expansion portion in thermal communication with the second heat exchanger and having an expansion cylinder and an expansion piston moving slidably in the expansion cylinder; and driving means for driving the compression piston and the expansion piston, the driving means including a first rod driving the compression piston and a second rod driving the expansion piston, wherein the compression cylinder comprises a first large diameter portion within which the compression piston is slidably moved and a first small diameter portion, having a diameter smaller than a diameter of said first large diameter portion, within which the first rod is slidably moved, and wherein the expansion cylinder comprises a second large diameter portion within which the expansion piston is slidably moved and a second small diameter portion, having a diameter smaller than that of said second large diameter portion, within which the second rod is slidably moved.

2. A refrigeration system as set forth in claim 1, wherein the refrigeration is comprised of a main-refrigerator and sub-refrigerator, and wherein a sub heat exchanger is thermally connected with the first heat exchanger.

* * * * *